United States Patent [19]

VanManen

[11] 4,340,154

[45] Jul. 20, 1982

[54] CAULKER FOR DISPENSING TWO VISCOUS COMPONENTS

[75] Inventor: Dick T. VanManen, Canandaigua, N.Y.

[73] Assignee: Voplex Corporation, Pittsford, N.Y.

[21] Appl. No.: 206,886

[22] Filed: Nov. 14, 1980

Related U.S. Application Data

[63] Continuation-in-part of Ser. No. 200,474, Oct. 24, 1980, abandoned.

[51] Int. Cl.[3] ..... B65D 35/22; B65D 35/30

[52] U.S. Cl. ..... 222/94; 222/88; 222/136

[58] Field of Search ..... 222/94, 95, 136, 137, 222/214, 386, 386.5

[56] References Cited

U.S. PATENT DOCUMENTS

| | | | |
|---|---|---|---|
| 1,698,404 | 1/1929 | Hopkins | 222/94 |
| 3,266,671 | 8/1966 | Gelpey | 222/137 X |
| 3,323,682 | 6/1967 | Creighton et al. | 222/137 X |
| 3,813,011 | 5/1974 | Harrison et al. | 222/94 X |
| 3,976,223 | 8/1976 | Jass et al. | 222/94 |
| 4,147,282 | 4/1979 | Levy | 222/389 X |

*Primary Examiner*—Robert J. Spar

*Assistant Examiner*—Frederick R. Handren

*Attorney, Agent, or Firm*—Stonebraker, Shepard & Stephens

[57] ABSTRACT

A caulker 10 dispenses two viscous components contained separately in inner and outer molded resin chambers. The outer chamber 12 holds one of the components 14 around the inner chamber 11 and is generally cylindrical with standard dimensions to fit existing caulking guns and dispensing equipment. The second component 15 is held within collapsible inner chamber 11 aranged inside outer chamber 12 and having accordion pleats that collapse when axially compressed. Inner chamber 11 has a rear end filling opening 17, and a molded resin plunger 13 fitting closely within outer chamber 12 is secured to the rear end of inner chamber 11. The forward regions of both chambers join and form passageways merging at the forward end of caulker 10. Inner chamber 11 is sealed by an openable barrier 22, and a removable closure element 26 seals outer chamber 12. When barrier 22 is opened and closure element 26 is removed and a nozzle 30 with a static mixer 31 is attached, plunger 13 can advance within outer chamber 12 and collapse inner chamber 11 forcing both components 14 and 15 from their chambers and through static mixer 31 before being dispensed out nozzle 30.

14 Claims, 7 Drawing Figures

CAULKER FOR DISPENSING TWO VISCOUS COMPONENTS

RELATED APPLICATIONS

This application is a continuation-in-part of my parent application Ser. No. 200,474, filed Oct. 24, 1980, entitled CAULKER FOR DISPENSING TWO VISCOUS COMPONENTS, and abandoned upon the filing of this continuation-in-part application.

BACKGROUND

Caulkers that are widely used as dispensing containers for sealants, adhesives, and caulking compounds have not been available for two component materials such as epoxies that require separate storage of highly viscous materials and mixing these materials together immediately before use. The two component dispensers that exist for liquids, pastry decoration, and other light duty purposes are not suitable for highly viscous, resinous materials presently used in two component adhesives and sealants.

After studying this problem, I have devised a caulker for dispensing two viscous components in a simple and effective way. My device provides secure storage and simple dispensing by using existing guns and allows convenient and effective operation.

SUMMARY

My inventive caulker dispenses two viscous components contained in two separate, molded resin chambers. A generally cylindrical outer chamber contains a collapsible inner chamber having accordion pleats that fold in a predetermined accordion collapse when compressed. The inner chamber has a rear end filling opening, and a molded resin plunger is secured to the rear end of the inner chamber and shaped to fit closely within the outer chamber. The forward regions of both chambers are joined, and passageways from each chamber merge at the forward end of the caulker. An openable barrier seals the forward end of the inner chamber, and a removable closure element seals the forward end of the outer chamber. A static mixer and nozzle are attached to the forward end of the outer chamber in communication with the passageways after the barrier seal is opened and the closure element is removed. The plunger then advances within the outer chamber while collapsing the inner chamber to force both components from their chambers through the passageways, static mixer, and nozzle.

DRAWINGS

DETAILED DESCRIPTION

Figure 1:
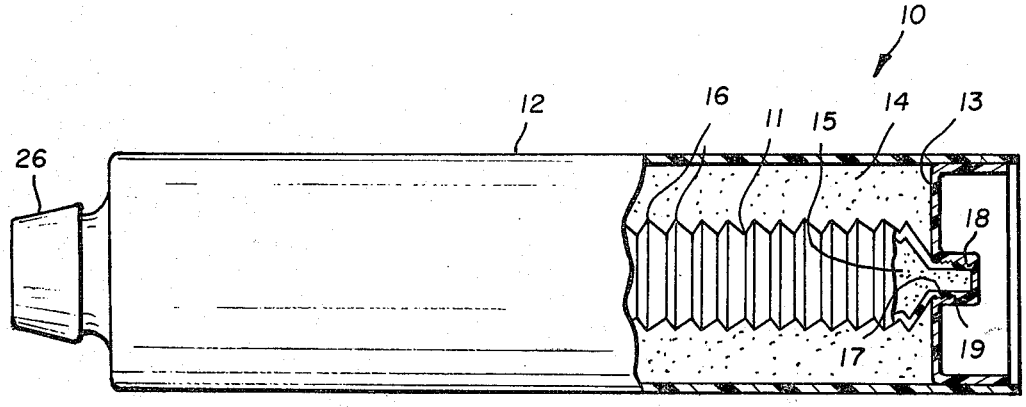
FIG. 1 is a partially cut away, side elevational view of a preferred embodiment of the inventive caulker fully loaded and sealed with a cap.
Figure 2:
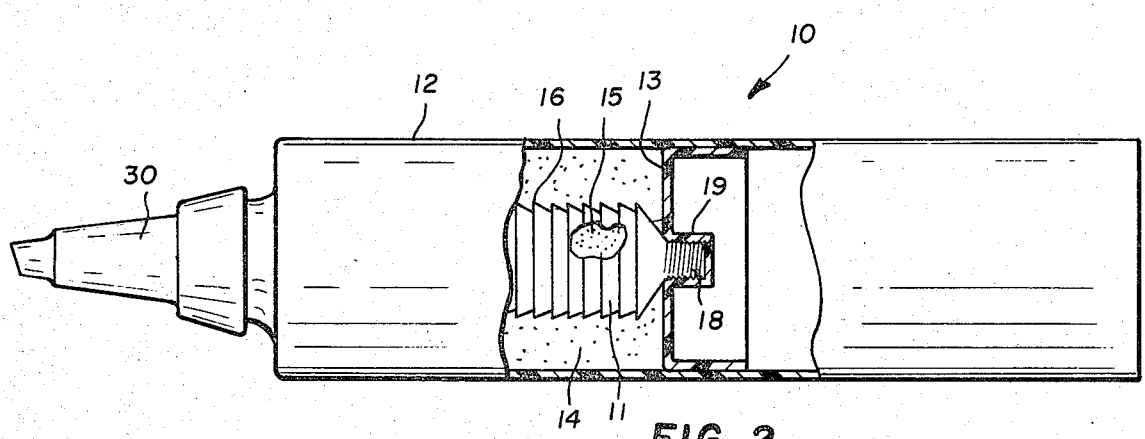
FIG. 2 is a partially cut away, side elevational view of the caulker of FIG. 1 with the contents partially dispensed through a nozzle.

My illustrated preferred embodiment uses an accordion-pleated, collapsible inner chamber 11 arranged within a generally cylindrical outer chamber 12 in which a plunger 13 is fitted. One component 14 is stored in outer chamber 12 around inner chamber 11, and the other component 15 is stored within inner chamber 11. Advancing plunger 13 then collapses inner chamber 11 to force component 15 forward and also presses component 14 forward with a piston action so that both components are expelled at the forward end of the caulker. The preferred way to accomplish this is explained below relative to FIGS. 3 and 4.

Outer chamber 12 is generally cylindrical and molded of resin material in dimensions that preferably fit existing caulking guns and dispensing equipment so that caulker 10 can be used just like existing caulkers. Forming caulker 10 of plastic materials also keeps the cost low, protects both the stored components, and takes advantage of known technology in the caulker art.

Inner chamber 11 is also molded of resin material with preformed accordion pleats 16 shaped to fold in a predetermined accordion collapse when inner chamber 11 is axially compressed. Chamber 11 is preferably arranged concentrically within chamber 12 as illustrated, but can also be axially offset, have a shape other than cylindrical, and even be divided to hold more than one component. Its rear end has a filling opening 17 and external screw threads 18 that mate with a threaded socket 19 on plunger 13. This allows collapsible chamber 11 to be filled with component 15 via rear opening 17, which is then closed by screwing socket 19 of plunger 13 over threads 18. Plunger 13 thus serves both as a closure cap and mounting support for inner chamber 11 and as a piston dispenser sliding within outer chamber 12.

Figure 3:
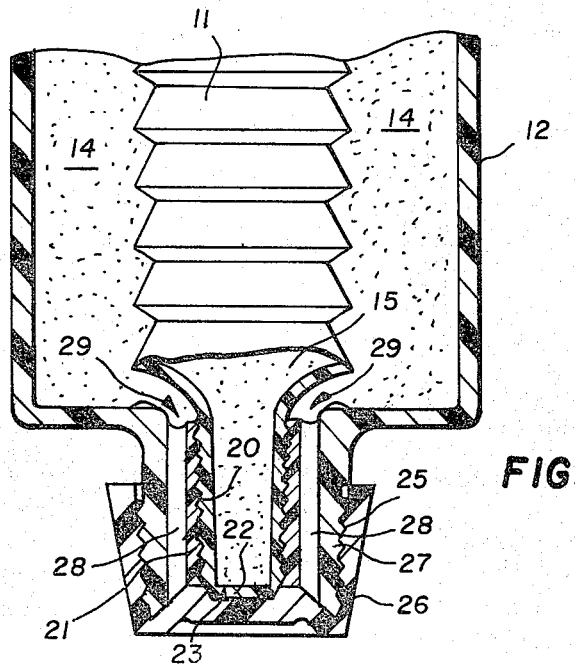
FIG. 3 is an enlarged, fragmentary cross-sectional view of the forward region of the caulker of FIG. 1.
Figure 4:
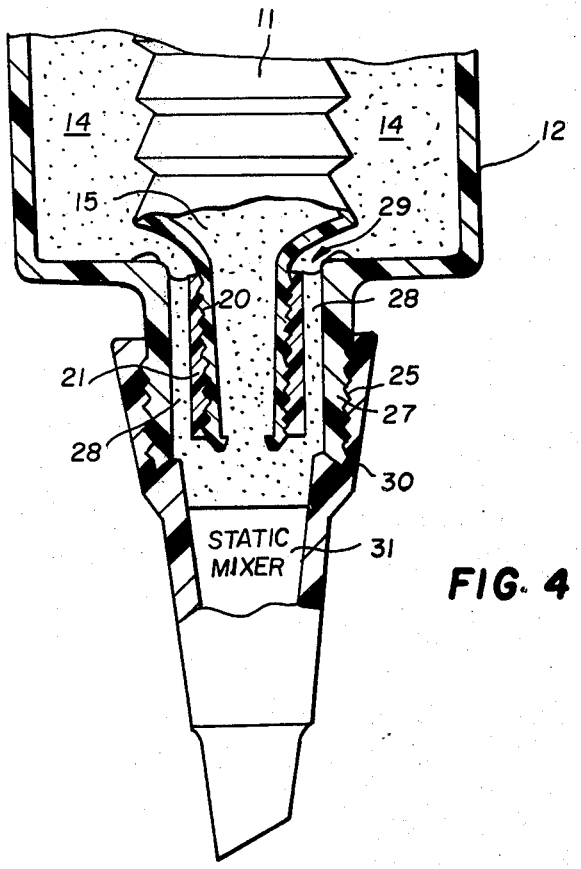
FIG. 4 is an enlarged, fragmentary cross-sectional view of the forward region of the caulker of FIG. 2.

Inner chamber 11 also has an external thread 20 formed on its forward end for screwing into a socket 21 formed in the forward end of outer chamber 12 as best shown in FIGS. 3 and 4. This anchors inner chamber 11 securely relative to the forward end of outer chamber 12. An openable barrier 22 closes the forward end of inner chamber 11, and barrier 22 is removable around a line of weakness 23 to open inner chamber 11 for dispensing. Foil seals secured in place and molded tips that can be cut away are alternative possibilities for sealing the forward end of chamber 11.

At its forward end, outer chamber 12 has an external screw thread 25 on a neck 27 on which closure cap 26 is screwed to seal the forward end of caulker 10 before use. Radial spacer fins 28 support threaded socket 21 within neck 27 and also form a passageway 29 for component 14. Closure cap 26 is shaped to fit snugly against the forward surfaces of neck 27 and socket 21 to close off and seal passageway 29. Cap 26 also preferably fits snugly against the forward end of inner chamber 11 so that both components are securely sealed in place before use.

Caulker 10 also includes a dispenser nozzle 30 with a static mixer 31 in a dispensing passageway forming an output from caulker 10. Nozzle 30 screws onto thread 25 in place of cap 26. When cap 26 is unscrewed, passageway 29 for component 14 is opened up; and when barrier 22 is removed, the forward end of chamber 11 forms an open passageway for component 15. Then with nozzle 30 screwed in place, components 14 and 15 are forced forward by plunger 13 to merge within nozzle 30 and mix together as they are forced through static mixer 31 and dispensed from caulker 10.

After partially dispensing the contents of caulker 10, nozzle 30 can be unscrewed and replaced with cap 26, which is preferably shaped to seat and seal both the inner and outer chambers to protect both components. Cap 26 can bear against several surfaces of each chamber for this purpose.

A foil seal adhered to the forward end of outer chamber 12 can be substituted for screw cap 26, especially for caulkers intended for the building trades, with their dispensing equipment and relatively rapid consumption.

All the parts of the illustrated preferred embodiment can be molded of resin material and made lightweight, sturdy, and economical. Chamber 11 can be filled either before or after it is screwed into chamber 12, and plunger 13 doubles as a cap for chamber 11. Chamber 12 is preferably filled from the front after chamber 11 is in place, and chambers 11 and 12 can be properly dimensioned to dispense components 14 and 15 in the right proportions.

Figure 5:
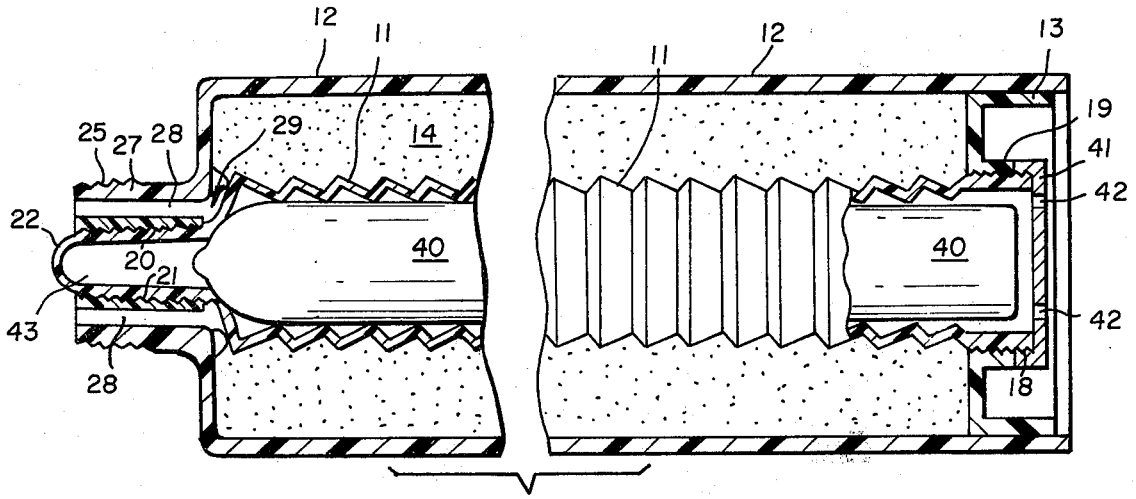
FIG. 5 is an enlarged, fragmentary cross-sectional view of an alernative preferred embodiment of a caulker according to my invention.
Figure 6:
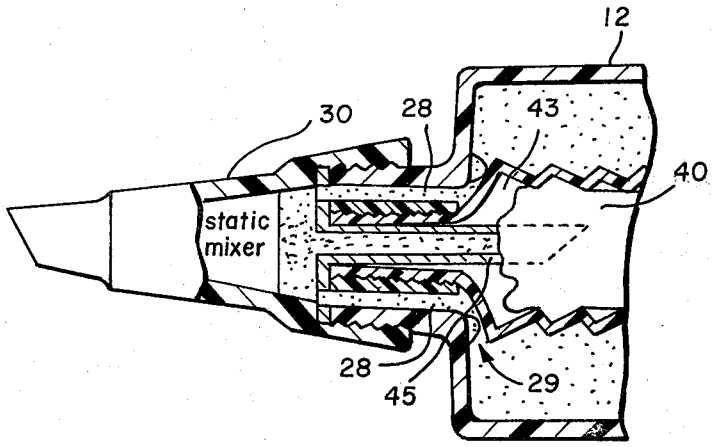
FIG. 6 is an enlarged, fragmentary cross-sectional view of the forward region of another alternative preferred embodiment of my invention.
Figure 7:
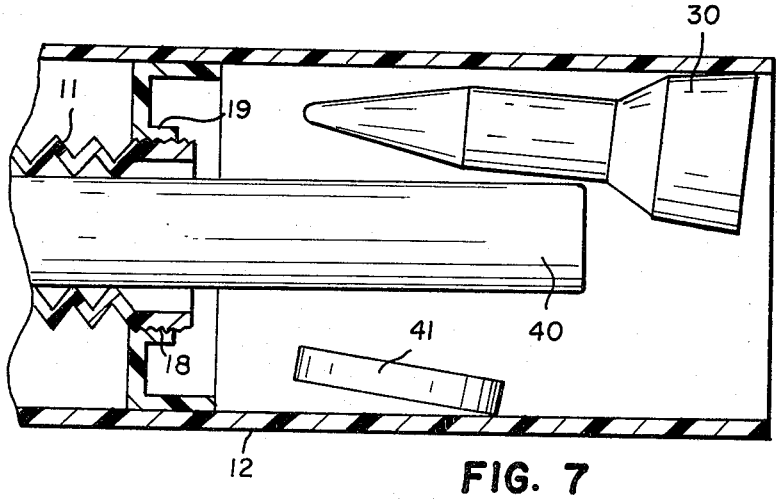
FIG. 7 is an enlarged, fragmentary cross-sectional view of the rear region of another preferred embodiment of my invention.

FIGS. 5–7 show several other alternatives for practicing the invention. To provide extra security for storing component 15 in isolation from component 14, a pouch 40 can be arranged within inner chamber 11 to hold component 15. Pouch 40 can be formed in generally known ways of foil, resin, or foil and resin laminates that can securely seal in component 15.

Using a pouch 40 within inner chamber 11 also allows caulker 10 to serve as a three-component dispenser because one component can be placed within pouch 40, the remainder of inner chamber 11 can be filled with another component around pouch 40, and a third component can be filled into outer chamber 12 around inner chamber 11.

Since pouch 40 cannot completely fill the inside of accordion-pleated chamber 11, the empty volume within chamber 11 outside of pouch 40 has to be vented as chamber 11 collapses. One preferred way to accomplish this is with a chamber cap 41 having vent holes 42 and screwed to external threads 18 on the rear end of inner chamber 11. This can be done if socket 19 of plunger 13 is formed as a through opening that can thread far enough onto threads 18 to allow chamber cap 41 to be screwed onto the rear end of chamber 11 behind plunger 13. Then as the plunger advances, air trapped in chamber 11 around pouch 40 can escape through vent holes 42.

Making the rear opening of chamber 11 relatively large facilitates rear end filling or insertion of pouch 40, and chamber cap 41 can be used without vent holes 42 for closing the rear end of chamber 11 when it is directly filled with component 15 or filled with a third component surrounding pouch 40.

Pouch 40 has to be punctured or torn near its forward end before dispensing begins, and a preferred way of accommodating this is shown in FIG. 5. Barrier 22 for inner chamber 11 is formed as a rounded tip that can be cut off to open a dispensing passageway 43 from inner chamber 11. Then a puncturing tool such as a nail or awl can be inserted through passage 43 and into pouch 40 to puncture the forward end of pouch 40 and allow its contents to escape through passageway 43 as chamber 11 collapses.

Another way of puncturing pouch 40 as shown in FIG. 6 is with a needle 45 that is pushed into dispenser passageway 43 to puncture bag 40 before nozzle 30 is screwed in place.

Rather than venting inner chamber 11 around pouch 40, pouch 40 can be made large enough to hold a volume equal to the full volume of chamber 11 and extend rearwardly of chamber 11 before use. Outer chamber 12 is preferably extended rearwardly as illustrated in FIG. 7 to accommodate a longer pouch 40 for this purpose. Pouch 40 can then be opened and emptied into chamber 11 just before dispensing begins, and chamber 11 can be closed with an unvented chamber cap 41. Nozzle 30 and cap 41 can be stored in the space around pouch 40 provided by elongating outer chamber 12 so that all necessary components are available in a single package.

Many different component shapes are possible, especially where the parts screw or otherwise fit together; and several alternatives are possible for seals and closure caps.

I claim:

1. A caulker for dispensing two viscous components, said caulker comprising:
   a. a generally cylindrical outer chamber, open at its rear end, formed of molded resin for holding one of said components;
   b. a collapsible inner chamber formed of molded resin and arranged within said outer chamber for holding the other of said components;
   c. said inner chamber being formed with accordion pleats for folding in a predetermined accordion collapse when said inner chamber is axially compressed;
   d. said inner chamber having a rear end filling opening;
   e. a molded resin plunger;
   f. means for securing said plunger to the rear end of said inner chamber;
   g. said plunger being shaped to fit closely within said outer chamber;
   h. means for joining a forward region of said inner chamber to a forward region of said outer chamber;
   i. passageways from each of said chambers merging at the forward end of said caulker;
   j. an openable barrier for sealing the forward end of said inner chamber passageway;
   k. a removable closure element for sealing the forward end of said outer chamber passageway; and
   l. a static mixer and nozzle joinable to the forward end of said outer chamber in place of said removable closure element to communicate with said passageways after opening said barrier and removing said closure element so that said plunger can advance within said outer chamber while collapsing said inner chamber to force both of said components from said chambers and through said passageways, said static mixer, and said nozzle.

2. The caulker of claim 1 including an external thread on said forward region of said outer chamber and wherein said closure element is a screw cap fitting on said thread and said nozzle screws onto said thread in place of said cap.

3. The caulker of claim 2 wherein said screw cap is replaceable after partial dispensing and is arranged to cover over and seal said passageways from each of said chambers.

4. The caulker of claim 1 wherein the rear end of said inner chamber is screwed to said plunger.

5. The caulker of claim 4 wherein said plunger has a threaded opening screwed to said inner chamber, and a chamber cap screws to said rear end of said inner chamber behing said plunger.

6. The caulker of claim 4 wherein the forward end of said inner chamber is screwed to said forward region of said outer chamber.

7. The caulker of claim 4 including an external thread on said forward region of said outer chamber and wherein said closure element is a screw cap fitting on said thread and said nozzle screws onto said thread in place of said cap.

8. The caulker of claim 7 wherein said screw cap is replaceable after partial dispensing and is arranged to cover over and seal said passageways from each of said chambers.

9. The caulker of claim 8 wherein the forward end of said inner chamber is screwed to said forward region of said outer chamber.

10. The caulker of claim 9 wherein said plunger has a threaded opening screwed to said inner chamber, and a chamber cap screws to said rear end of said inner chamber behind said plunger.

11. The caulker of claim 1 including a sealed pouch containing said other component and fitting within said inner chamber.

12. The caulker of claim 11 wherein said plunger has a threaded opening screwed to said inner chamber, and a chamber cap screws to said rear end of said inner chamber behind said plunger.

13. The caulker of claim 12 wherein said chamber cap has vent openings.

14. The caulker of claim 12 wherein said pouch is dimensioned to hold a volume approximately equal to the volume capacity of said inner chamber so said other component can be emptied from said pouch into said inner chamber before using said caulker.

* * * * *